US008915022B2

(12) United States Patent
Klink et al.

(10) Patent No.: US 8,915,022 B2
(45) Date of Patent: Dec. 23, 2014

(54) SYSTEM AND METHOD FOR MANAGEMENT OF A ROOF

(75) Inventors: Frank W. Klink, Oak Park Heights, MN (US); John S. Edwards, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/123,891

(22) PCT Filed: Jun. 6, 2012

(86) PCT No.: PCT/US2012/041031
§ 371 (c)(1), (2), (4) Date: Dec. 4, 2013

(87) PCT Pub. No.: WO2012/170483
PCT Pub. Date: Dec. 13, 2012

(65) Prior Publication Data

US 2014/0102013 A1 Apr. 17, 2014

Related U.S. Application Data

(60) Provisional application No. 61/494,266, filed on Jun. 7, 2011.

(51) Int. Cl.

| | |
|---|---|
| ***E04H 14/00*** | (2006.01) |
| ***E04H 9/00*** | (2006.01) |
| ***F24F 7/02*** | (2006.01) |
| ***E04D 13/17*** | (2006.01) |
| *F24F 7/00* | (2006.01) |

(52) U.S. Cl.
CPC ..... *F24F 7/025* (2013.01); *E04D 13/17* (2013.01); *F24F 7/02* (2013.01); *F24F 2007/004* (2013.01)
USPC ..... 52/1; 52/198; 52/199; 52/302.1; 52/302.3

(58) Field of Classification Search
CPC ..... E04D 13/17; E04D 13/172; E04D 13/174; E04D 13/152; E04D 13/178
USPC ..... 52/1, 198, 199, 302.1, 302.3
See application file for complete search history.

(56) References Cited

U.S. PATENT DOCUMENTS

| | | | |
|---|---|---|---|
| 1,259,914 | A | 3/1918 | Seward |
| 2,477,152 | A | 7/1949 | Stevenson |

(Continued)

FOREIGN PATENT DOCUMENTS

| | | |
|---|---|---|
| EP | 103559 | 8/1983 |
| GB | 2262295 | 6/1993 |

(Continued)

OTHER PUBLICATIONS

International Search Report for PCT International Application PCT/US2012/041031, mailed on Aug. 24, 2012, 3 pages.

(Continued)

*Primary Examiner* — Mark Wendell
(74) *Attorney, Agent, or Firm* — Craig A. Deutsch

(57) ABSTRACT

A system for management of a roof having first and second decks covering an unconditioned space in a building and a peak, the system having a first channel extending from proximate a lower end of the first deck towards the peak and a second channel extending from proximate a lower end of the second deck towards the peak. The system further includes a router positioned proximate the peak, the router enabling air flowing to the peak from the first channel to be selectively routed to one of a plurality of directions.

16 Claims, 12 Drawing Sheets

(56) References Cited

U.S. PATENT DOCUMENTS

| | | | | |
|---|---|---|---|---|
| 3,006,113 | A | 10/1961 | Barnes | |
| 3,058,265 | A | 10/1962 | Lapsensohn | |
| 3,062,683 | A | 11/1962 | Kalleberg | |
| 3,660,955 | A | 5/1972 | Simon | |
| 3,683,785 | A | 8/1972 | Grange | |
| 3,686,813 | A | 8/1972 | Breitwieser | |
| 3,797,180 | A | 3/1974 | Grange | |
| 4,125,971 | A | 11/1978 | Ward | |
| 4,181,752 | A | 1/1980 | Martens | |
| 4,189,878 | A | 2/1980 | Fitzgerald | |
| 4,237,672 | A | 12/1980 | Peterson | |
| 4,254,598 | A | 3/1981 | Rugroden | |
| 4,329,384 | A | 5/1982 | Vesley | |
| 4,406,095 | A | 9/1983 | Slavik | |
| 4,446,661 | A | 5/1984 | Jonsson | |
| 4,557,960 | A | 12/1985 | Vernon | |
| 4,635,419 | A | 1/1987 | Forrest | |
| 4,642,518 | A | 2/1987 | Dard | |
| 4,660,463 | A | 4/1987 | Bottomore | |
| 4,677,903 | A | 7/1987 | Mathews, III | |
| 4,737,559 | A | 4/1988 | Kellen | |
| 4,781,243 | A | 11/1988 | DeVogel | |
| 4,852,314 | A | 8/1989 | Moore, Jr. | |
| 4,977,714 | A | 12/1990 | Gregory, Jr. | |
| 5,060,444 | A | 10/1991 | Paquette | |
| 5,295,339 | A | 3/1994 | Manner | |
| 5,487,247 | A | 1/1996 | Pigg | |
| 5,524,381 | A | 6/1996 | Chahroudi | |
| 5,549,513 | A | 8/1996 | Thomas | |
| 5,596,847 | A | 1/1997 | Stephenson | |
| 5,600,928 | A | 2/1997 | Hess | |
| 5,630,752 | A | 5/1997 | Gubash | |
| 5,673,521 | A | 10/1997 | Coulton | |
| 5,766,071 | A | 6/1998 | Kirkwood | |
| 5,804,610 | A | 9/1998 | Hamer | |
| 6,049,419 | A | 4/2000 | Wheatley | |
| 6,061,978 | A | 5/2000 | Dinwoodie | |
| 6,092,344 | A | 7/2000 | Kelly | |
| 6,220,956 | B1 * | 4/2001 | Kilian et al. | 454/239 |
| 6,269,598 | B1 * | 8/2001 | Wintermantel | 52/220.1 |
| 6,294,249 | B1 | 9/2001 | Hamer | |
| 6,346,040 | B1 | 2/2002 | Best | |
| 6,357,193 | B1 | 3/2002 | Morris | |
| 6,487,826 | B1 | 12/2002 | McCorsley | |
| 6,677,402 | B2 | 1/2004 | Gaddam | |
| 6,756,098 | B2 | 6/2004 | Zhou | |
| 6,780,099 | B1 * | 8/2004 | Harper | 454/186 |
| 6,797,396 | B1 | 9/2004 | Liu | |
| 6,927,900 | B2 | 8/2005 | Liu | |
| 6,955,012 | B2 | 10/2005 | Suzuki | |
| 7,077,124 | B2 | 7/2006 | Szymocha | |
| 7,169,459 | B2 | 1/2007 | Lichodziejewski | |
| 7,231,744 | B2 * | 6/2007 | Cooper et al. | 52/199 |
| 7,302,776 | B2 | 12/2007 | Duncan | |
| 7,389,619 | B2 * | 6/2008 | Willert | 52/302.3 |
| 7,389,699 | B2 | 6/2008 | Kelly | |
| 7,455,899 | B2 | 11/2008 | Gross | |
| 7,565,775 | B2 * | 7/2009 | Cooper et al. | 52/199 |
| 7,648,755 | B2 | 1/2010 | Gross | |
| 7,758,408 | B2 | 7/2010 | Hagentoft | |
| 7,805,905 | B2 | 10/2010 | Rodrigues | |
| 8,065,841 | B2 | 11/2011 | Antonic | |
| 8,221,200 | B2 * | 7/2012 | Oaten | 454/186 |
| 2001/0009714 | A1 | 7/2001 | Wheatley | |
| 2003/0099780 | A1 | 5/2003 | Christ | |
| 2003/0126806 | A1 | 7/2003 | Ellis | |
| 2005/0170164 | A1 | 8/2005 | Christ | |
| 2005/0243425 | A1 | 11/2005 | Wheatley | |
| 2005/0246973 | A1 | 11/2005 | Jensen | |
| 2006/0005491 | A1 * | 1/2006 | Cooper et al. | 52/302.1 |
| 2006/0218869 | A1 | 10/2006 | Ellis | |
| 2007/0072541 | A1 | 3/2007 | Daniels, II | |
| 2007/0243820 | A1 | 10/2007 | O'Hagin | |
| 2008/0113612 | A1 | 5/2008 | Chich | |
| 2008/0152867 | A1 | 6/2008 | Di Pede | |
| 2008/0236058 | A1 | 10/2008 | Antonie | |
| 2009/0203308 | A1 | 8/2009 | O'Hagin | |
| 2010/0229498 | A1 | 9/2010 | Pollack | |
| 2010/0330898 | A1 | 12/2010 | Daniels | |
| 2011/0030287 | A1 | 2/2011 | Moore | |
| 2011/0265407 | A1 | 11/2011 | Bryson | |
| 2012/0266553 | A1 | 10/2012 | Shiao | |
| 2013/0184394 | A1 | 7/2013 | Satrijo | |
| 2013/0217318 | A1 | 8/2013 | Edwards | |

FOREIGN PATENT DOCUMENTS

| | | |
|---|---|---|
| GB | 2457088 | 8/2009 |
| WO | 01-57152 | 8/2001 |
| WO | WO 2008-070386 | 6/2008 |
| WO | WO 2010-002557 | 1/2010 |
| WO | WO 2010-147811 | 12/2010 |
| WO | WO 2012-033816 | 3/2012 |
| WO | WO 2013-096171 | 6/2013 |

OTHER PUBLICATIONS

European Application 12796084 Search Report dated Oct. 13, 2014.

* cited by examiner

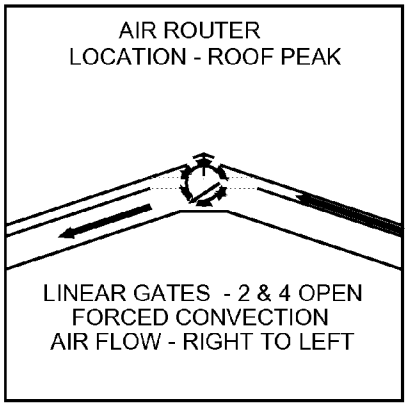
FIG. 10A
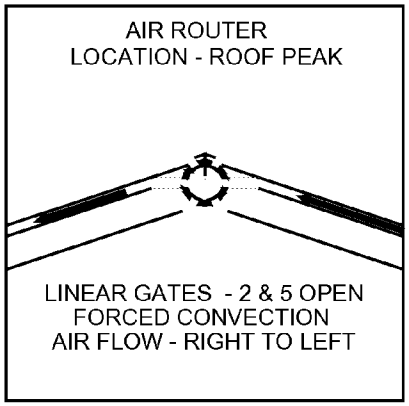
FIG. 10B
FIG. 10C
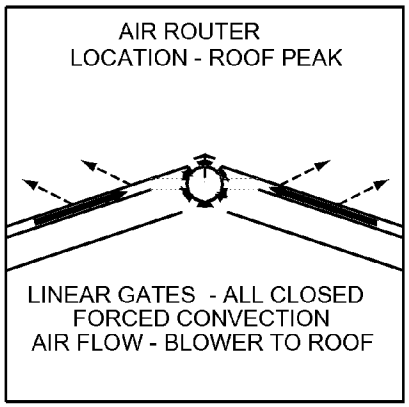
FIG. 10D
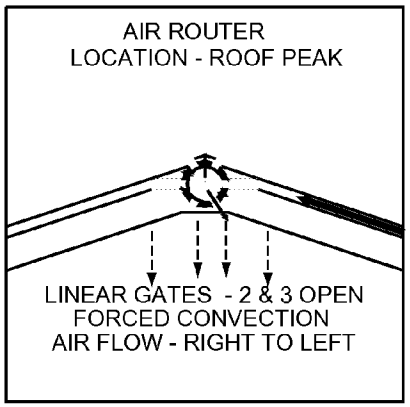
FIG. 10E
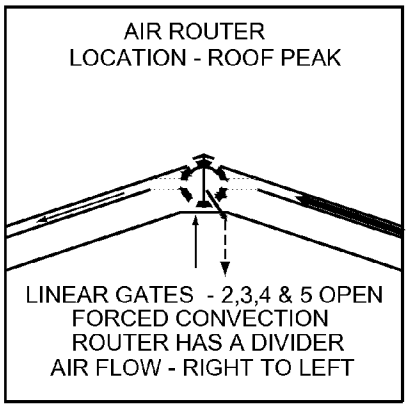
FIG. 10F

SYSTEM AND METHOD FOR MANAGEMENT OF A ROOF

CROSS REFERENCE TO RELATED APPLICATIONS

This application claims the benefit of U.S. Provisional Patent Application No. 61/494,266, filed Jun. 7, 2011, which is incorporated herein by reference in its entirety.

FIELD

This disclosure generally relates to building products. More particularly, this disclosure relates to a system, components, and method for managing loads and conditions, such as airflow, thermal loads, and environmental conditions, in buildings.

BACKGROUND

Traditionally, pitched roofs include a protective covering, such as tiles or shingles, presented on a roof board or "deck" that covers an unconditioned space or "attic." The attic can serve as a buffer to a conditioned, living space below the attic. It can desirable to attempt to maintain the temperature of the attic, through the use of ventilation, so that the temperature of the attic is at or near the outside environmental air temperature.

Such ventilation can be done using soffit vents and roof or ridge vents. Even if such vents are included, however, they can be inadequate and/or deteriorate with the age of the home. As a result, roofs can develop unwanted thermal heat loads (heat gains) in the conditioned, living space in the summer season and the removal of thermal heat (heat loss) in the conditioned, living space during the winter period.

Furthermore, many heat loads can be caused by "radiant" heat, which can cause high cooling energy costs in buildings, particularly in warm southern climates that receive a high incidence of solar radiation. It is not uncommon for the air temperature within a space adjacent to or under a roof to exceed the ambient outside air temperature by 40° F. (about 22° C.) or more, due to absorption of solar energy by the roof. This can lead to a significant energy cost for cooling the living spaces of a building to a comfortable living temperature. Most homes do not have solutions for managing or reducing radiant heat.

Also, in colder climates, traditional roofs can have inadequate air flow from the soffit to the peak exit can lead to ice build-up or "ice dams" at the lower eaves area. Ice dams form when there is snow on the roof and removal of thermal heat (heat loss) of the conditioned space, or heat from solar gain absorbed by the portions of the roof that are not snow covered, melts snow on the roof. The resulting water travels down the roof to lower portions of the roof that are below 32° F. (usually at the eves) and the water refreezes. The ice then forms a small dam that slowly builds up and, eventually, the water can back up behind the dam. This backed-up water can then work its way under the shingles and leak into the space below. Poor unconditioned space ventilation in colder climates can also lead to build up of frost and condensation that form on the underside of the roof.

BRIEF SUMMARY

This disclosure provides a system, components, and method for managing airflow by or within the roof system, the thermal heat loads and heat loss of the roof system, the temperature of conditioned and/or unconditioned spaces in a building, and the ventilation of the conditioned and/or unconditioned spaces in a building. The subject matter of this disclosure, in its various combinations, either in apparatus or method form, may include the following list of embodiments:

1. A system for management of thermal loads relative to a roof having first and second decks covering an unconditioned space in a building and a peak, said system comprising:

a first channel extending from proximate a lower end of the first deck towards the peak and a second channel extending from proximate a lower end of the second deck towards the peak; and a router positioned proximate the peak, said router enabling air flowing to the peak from said first channel to be selectively routed to one of a plurality of directions.

2. The system of embodiment 1, wherein said plurality of directions are selected from the group consisting of:

out of a peak vent included at the peak and into the atmosphere, to said second channel, back to said first channel, into the unconditioned space, into an heat recovery unit, into an air make-up unit, and any combinations thereof.

3. A roofing article for use in the system of any one of the preceding embodiments, said roofing article comprising a body and a roofing article channel defined therein, such that when said roofing article is arranged on said first deck, said roofing article channel forms at least a portion of said first channel.

4. A roof covering for use in the system of any one of embodiments 1 to 2, said roofing covering comprising a plurality of roofing articles, each roofing article comprising a body and a roofing article channel defined in said body, such that when said plurality of roofing articles are arranged on said first deck, said roofing article channels of said plurality of roofing articles arranged on said first deck collectively form at least a portion of said first channel and when said plurality of roofing articles are arranged on said second deck, said roofing article channels of said plurality of roofing articles arranged on said second deck collectively form at least a portion of said second channel.

5. The system of any one of embodiments 1 to 2, further comprising a covering presented on said first and second decks, said first channel being defined within said covering presented on the first deck and said second channel being defined within said covering presented on the second deck.

6. The system of embodiment 1, further comprising a covering presented on said first and second decks, said first channel being defined intermediate said first deck and said covering presented on the first deck and said second channel being defined intermediate said second deck and said covering presented on the second deck.

7. The system of any one of embodiments 4 to 6, further comprising one or more vents included in covering, said vents operably extending from said first channel to a top surface of covering.

8. The system of any one of embodiments 1 to 2, wherein said first channel and said second channel are positioned above the first deck and second deck, respectively.

9. The system of any one of embodiments 1 to 2, wherein said first channel and said second channel are positioned below the first deck and second deck, respectively.

10. The system of any one of the preceding embodiments, wherein said router is a linear actuator.

11. The system of any one of the preceding embodiments, further comprising a selectively openable and closeable vent proximate a lower end of the first deck, such that said vent, when opened, enables air to enter into or exit out of said first channel.

12. The system of any one of the preceding embodiments, further comprising a selectively openable and closeable vent proximate a lower end of the second deck, such that said vent, when opened, enables air to enter into or exit out of said second channel.

13. The system of any one of the preceding embodiments, further comprising an air movement component to effect movement of air in at least one of said first and second channels.

14. The system of embodiment 13, wherein said air movement component is a fan.

15. The system of any one of embodiments 13 to 14, wherein said air movement component is configured to push and pull air.

16. The system of any one of the preceding embodiments, further comprising one or more sensors presented with at least one of said first deck or said second deck.

17. The system of embodiment 16, wherein said one or more sensors comprise a sensor selected from the group consisting of: a temperature sensor, a moisture sensor, a heat flow sensor, an impact sensor, a fire sensor, and a carbon monoxide sensor, or combinations thereof.

18. The system of any one of embodiments 2 to 17, wherein said heat recovery unit comprises a dryer.

19. A method for releasing thermal loads using the system of any one of the preceding embodiments, wherein said air flowing to the peak from said first channel is selectively routed out of the peak vent into the atmosphere.

20. A method for collecting thermal loads using the system of any one of the preceding embodiments, wherein said air flowing to the peak from said first channel is selectively routed into the unconditioned space.

21. A method for using thermal loads from the first deck to heat the second deck using the system of any one of the preceding embodiments, wherein said air flowing to the peak from said first channel is selectively routed to said second channel.

22. A method for blowing off a roof covering using the system of embodiment 7, wherein said air flowing to the peak from said first channel is selectively routed to back to said first channel and out of said one or more vents included in said covering.

23. A method for using thermal loads from the first deck to heat a conditioned space using the system of any one of the preceding embodiments, wherein said air flowing to the peak from said first channel is selectively routed to an heat recovery unit.

24. A system for management of thermal loads relative to a building panel, said system comprising:

a first channel extending from proximate a lower end of the panel towards an upper end of the panel; and a router positioned proximate the upper end of the panel, said router enabling air flowing to the upper end of the panel from said first channel to be selectively routed to one of a plurality of directions.

25. The system of embodiment 24, wherein the panel comprises a roof deck.

26. The system of embodiment 24, wherein the panel comprises a wall.

27. A system for management of thermal loads relative to a roof having first and second decks covering an unconditioned space in a building and a peak, said system comprising:

a first channel extending from proximate a lower end of the first deck towards the peak and a second channel extending from proximate a lower end of the second deck towards the peak; and a router positioned proximate the lower end of the first deck, said router enabling air flowing to the lower end of the first deck from said first channel to be selectively routed to one of a plurality of directions selected from the group consisting of:

out of a vent included proximate the lower end of the first deck and into the atmosphere, back to said first channel, into the unconditioned space, into an heat recovery unit, into an air make-up unit and any combinations thereof.

BRIEF DESCRIPTION OF THE SEVERAL VIEWS OF THE DRAWINGS

The disclosure can be more completely understood in consideration of the following detailed description in connection with the accompanying drawings, in which:

FIGS. 10A-10F are schematic side views of a roof peak air router of this disclosure in various configurations;

Figure 1:
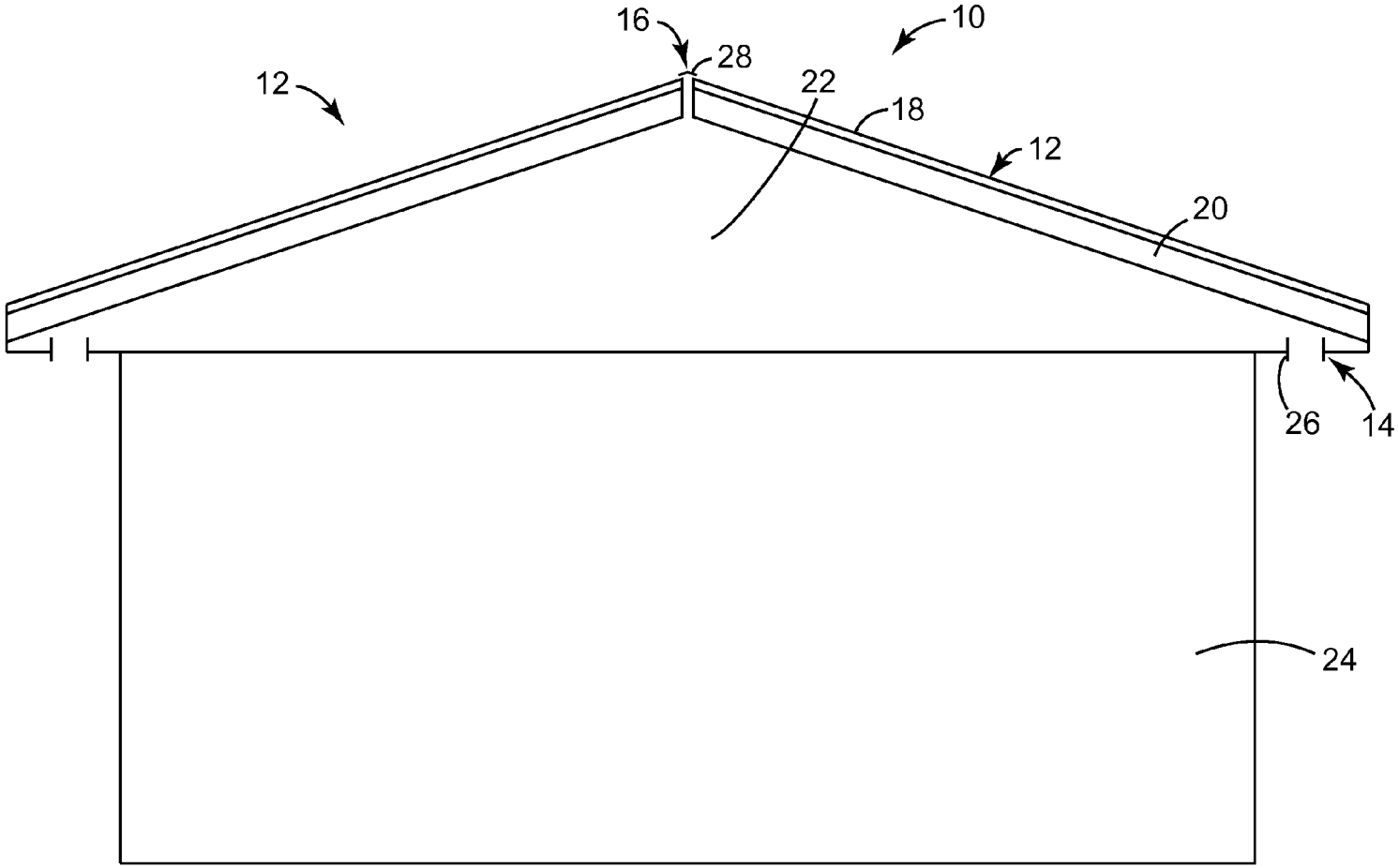
FIG. 1 PRIOR ART
FIG. 1 is a schematic side view of a traditional roof system.

While the above-identified figures depict an embodiment of the disclosed subject matter, other embodiments are also contemplated, such as those noted in the disclosure. In all cases, this disclosure presents the disclosed subject matter by way of representation only and not by limitation. The figures are schematic representations, for which reason the configuration of the different structures, as well as their relative dimensions, is for illustrative purposes only. Numerous modifications and embodiments can be recognized by those skilled in the art, which modifications and embodiments are within the scope and spirit of this disclosure.

DETAILED DESCRIPTION

This disclosure broadly relates to roof systems and methods of using such roof systems. Various exemplary embodiments of the disclosure will now be described with particular reference to the drawings. Embodiments of this disclosure may take on various modifications and alterations without departing from the spirit and scope of the disclosure. Accordingly, it is to be understood that the embodiments of this disclosure are not to be limited to the following described exemplary embodiments, but is to be controlled by the limitations set forth in the claims and any equivalents thereof. An appreciation of various aspects of the invention will be gained through a discussion of the examples provided below.

The following description should be read with reference to the drawings, in which like elements in different drawings are numbered in like fashion. The drawings, which are not necessarily to scale, depict selected illustrative embodiments and are not intended to limit the scope of the disclosure. Although examples of construction, dimensions, and materials are illustrated for the various elements, those skilled in the art will recognize that many of the examples provided have suitable alternatives that may be utilized.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

The recitation of numerical ranges by endpoints includes all numbers subsumed within that range (e.g. 1 to 5 includes 1, 1.5, 2, 2.75, 3, 3.80, 4, and 5) and any range within that range.

As used in this specification and the appended claims, the singular forms "a," "an," and "the" encompass embodiments having plural referents, unless the content clearly dictates otherwise. For example, reference to "a layer" encompasses embodiments having one, two or more layers. As used in this specification and the appended claims, the term "or" is generally employed in its sense including "and/or" unless the content clearly dictates otherwise.

The term "polymer" will be understood to include polymers, copolymers (e.g., polymers formed using two or more different monomers), oligomers and combinations thereof, as well as polymers, oligomers, or copolymers that can be formed in a miscible blend. Additionally, the terms "attic" and "unconditioned space" are used interchangeably herein.

Referring to FIG. 1, a traditional roof 10 generally includes one or more roof portions 12 extending between a soffit 14 and a roof peak or ridge 16. Roof 10 includes a protective covering 18, such as concrete or clay tiles or asphalt shingles, on a roof board or deck 20 that covers an unconditioned space or attic 22. Attic 22 can serve as a buffer to a living space 24 below the attic. Roof 10 can include vents 26 on the soffit and also vents on the roof (not depicted) and/or a ridge vent 28.

Figure 2:
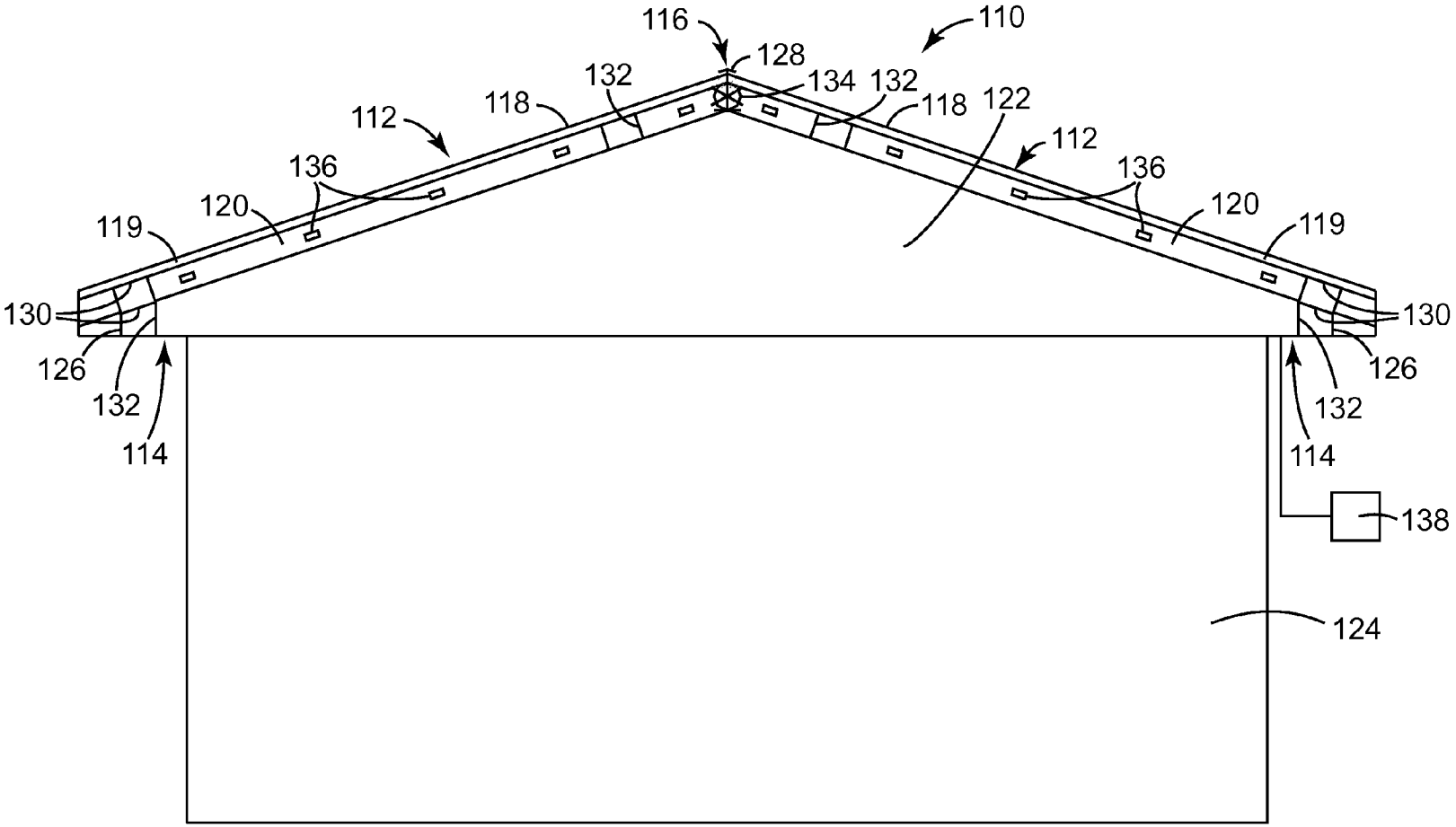
FIG. 2 is a schematic side view of a roof system of this disclosure.

Referring to FIG. 2, the roof system 110 according embodiments of this disclosure can include one or more roof portions 112, each having a roof board or deck 120, a soffit 114 having a soffit duct or vent 126 (which vent 126 can include an air router), a roof peak or ridge 116, and a protective covering 118, such as concrete or clay tiles or asphalt shingles, on deck 120. Roof system 110 further includes one or more passive or active roof management components. Such components can include, for example, vent open/close components 130 on the top and/or bottom of the soffit vent 126, one or more blowers or fans 132 (such as, for example, variable speed/high pressure fans and can be used to effect movement of air, such as the pushing and/or pulling of various air movements), one or more ridge air routing members or air routers 134 for routing air flow in the roof system 110 (see FIGS. 10A-10F), sensors or sensing members 136, such as, for example, moisture, temperature, heat flow, impact, fire, and carbon monoxide sensors.

In embodiments, sensors 136 can be moisture, temperature, heat flow, impact, fire, and carbon monoxide sensors. Those skilled in the art will recognize that other sensors can be used without departing from the spirit and scope of this disclosure.

In embodiments of roof system 110, protective covering 118 can include roof system including one or more channels 119 running partially or fully from the soffit region to or near the ridge or peak of the roof, such as that described in PCT International Publication No. WO 2012/033816 A1, entitled "ABOVE-DECK ROOF VENTING ARTICLE" and U.S. Patent Application No. 61/579,297, entitled "ABOVE-DECK ROOF VENTING ARTICLE," both of which are incorporated herein by reference in their entirety. Roof system 110 can further include one or more solar cells 138 and each of the roof system management components can, optionally, be solar-powered. Air routers 134 can be or include one or more air ducts that run along, such as parallel, ridge 116 of roof system 110. The cross section and/or shape of the ducts can vary with size and shape. The materials of air router 134 can be any of a number of materials, including, for example, lightweight, non-rusting metals and or various low-high temperature polymers, although those skilled in the art would recognize that other materials can be used. Electric-actuated linear actuators can be included to create various valve ports of air router 134. Other methods of mechanical gating can be used in air router 134 are contemplated. Output from software can close or open the respective gates to enable natural and or forced air flow through air router 134. Depending on climate zone location and secondary operations tied to roof system 110, air router 134 can have multiple ports. The examples have been shown for four-way and six-way ports, although other air router 134 configurations, including more than six ports or less than four ports are contemplated.

The roof system 110 of embodiments can include controls (including, for example, hardware and/or software, not depicted) to enable further optimization of the thermal energy management of a building and for controlling the roof system management components. For example, the temperature and relative humidity/dew point temperature of an unconditioned attic space can automatically effect air flow movement using roof system. Likewise, structure ventilation could trigger air flow movements to mechanical devices or buffering heat/cold air.

Figure 3A:
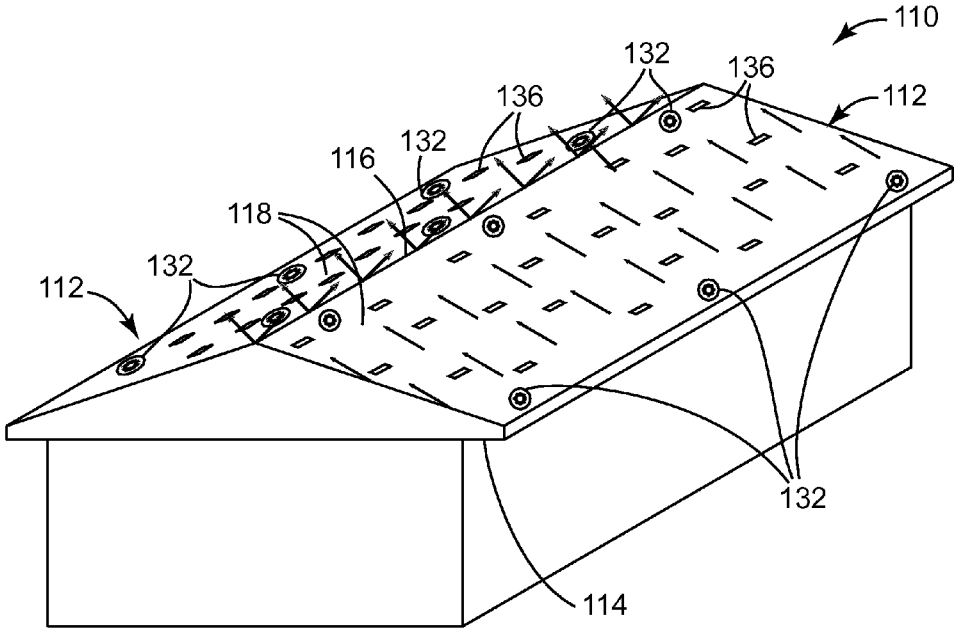
FIG. 3A is a schematic perspective view of a roof system of an embodiment of this disclosure.
Figure 3B:
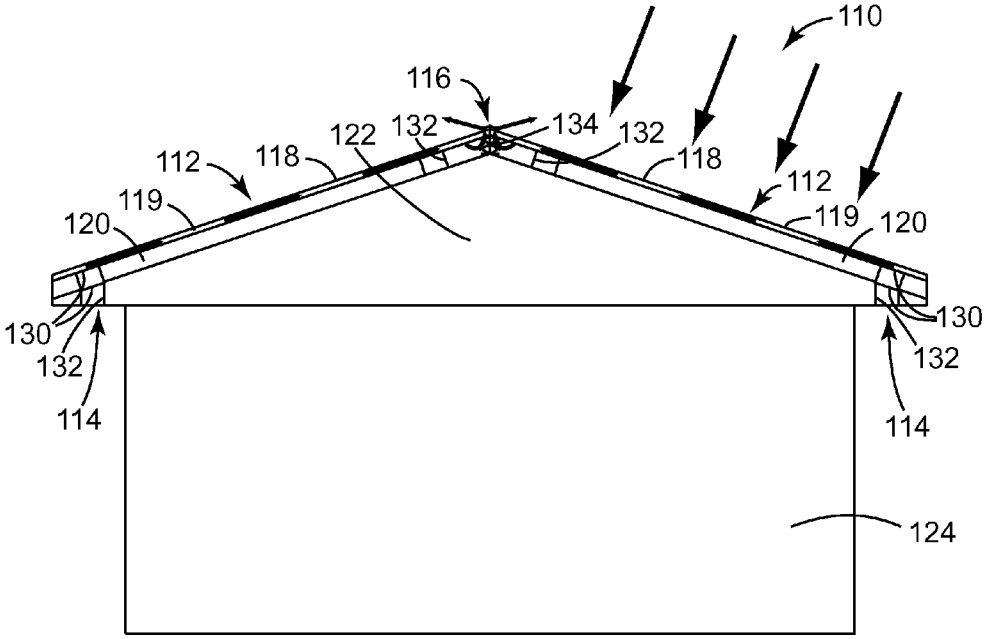
FIG. 3B is schematic side view of the roof system of FIG. 3A.

Referring to FIGS. 3A and 3B, in a first embodiment, radiant energy is depicted as impinging upon the right roof portion 112 of roof system 110. Positions 1, 2, 5 and 6 of air router 134 can be open (see FIG. 10A), which routes warmer air from both roof portions 112 of roof system 110 up to ridge 116, such as through a channel or channels 119 included in at which point the warmer air exits. Air router 134 generally extends along substantially the entire length of ridge 116.

Figure 4A:
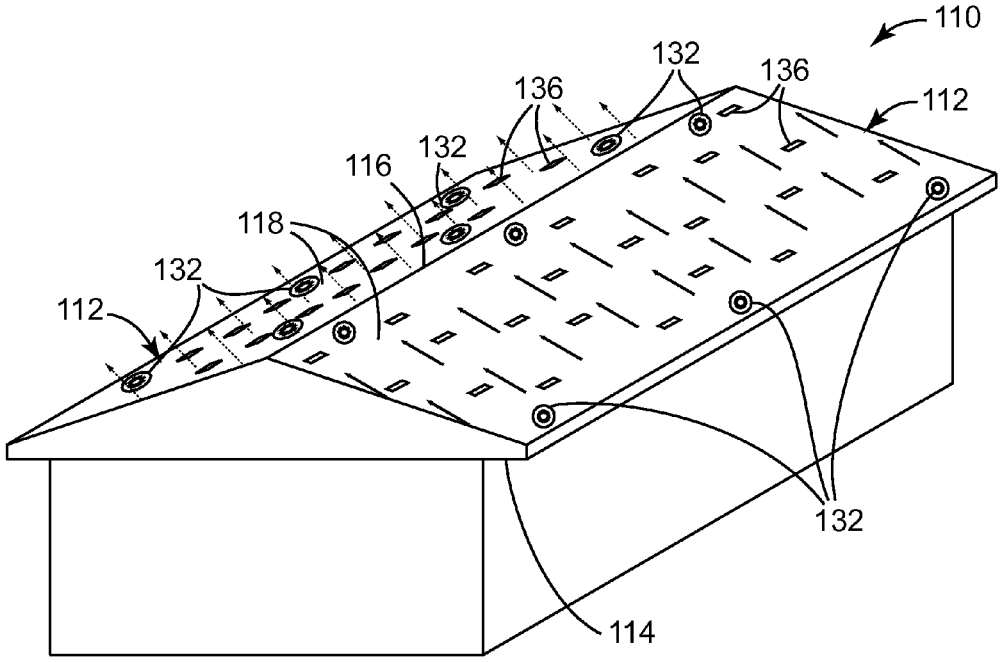
FIG. 4A is a schematic perspective view of a roof system of a further embodiment of this disclosure.
Figure 4B:
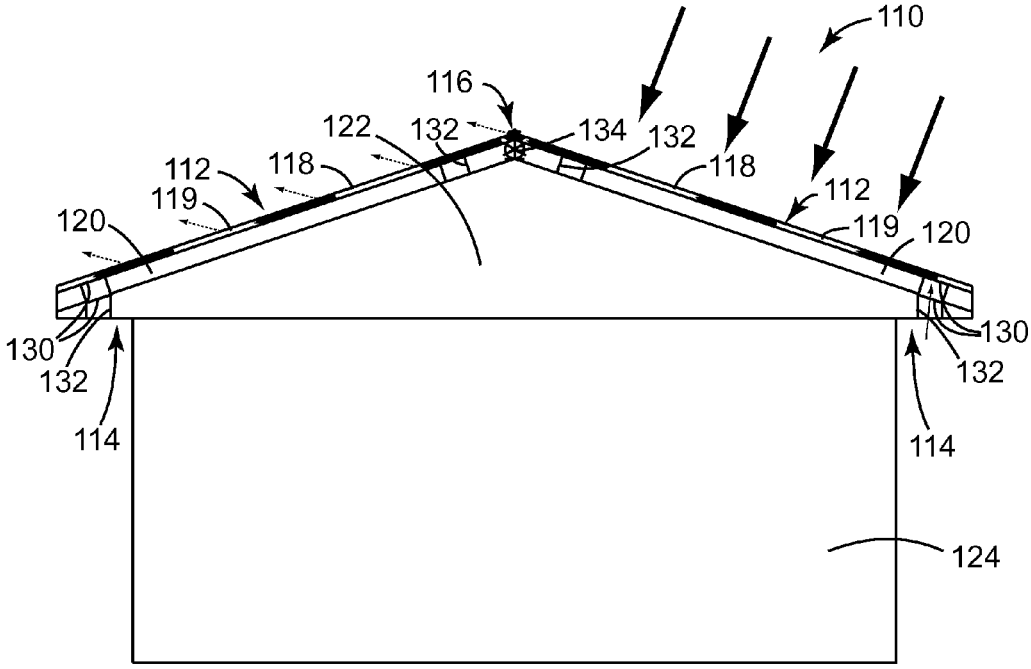
FIG. 4B is schematic side view of the roof system of FIG. 4A.

Referring to FIGS. 4A and 4B, in a second embodiment, radiant energy is depicted as impinging upon the right roof portion 112 of roof system 110. Blower 132 on right roof portion 112 can be set to push soffit air and the blower 132 on left roof portion 112 can be set to pull warmer air. Positions 2 and 5 of air router 134 can be open (see FIG. 10B). The warmer air is then routed from the warmer right roof portion to cooler left roof portion.

Figure 5A:
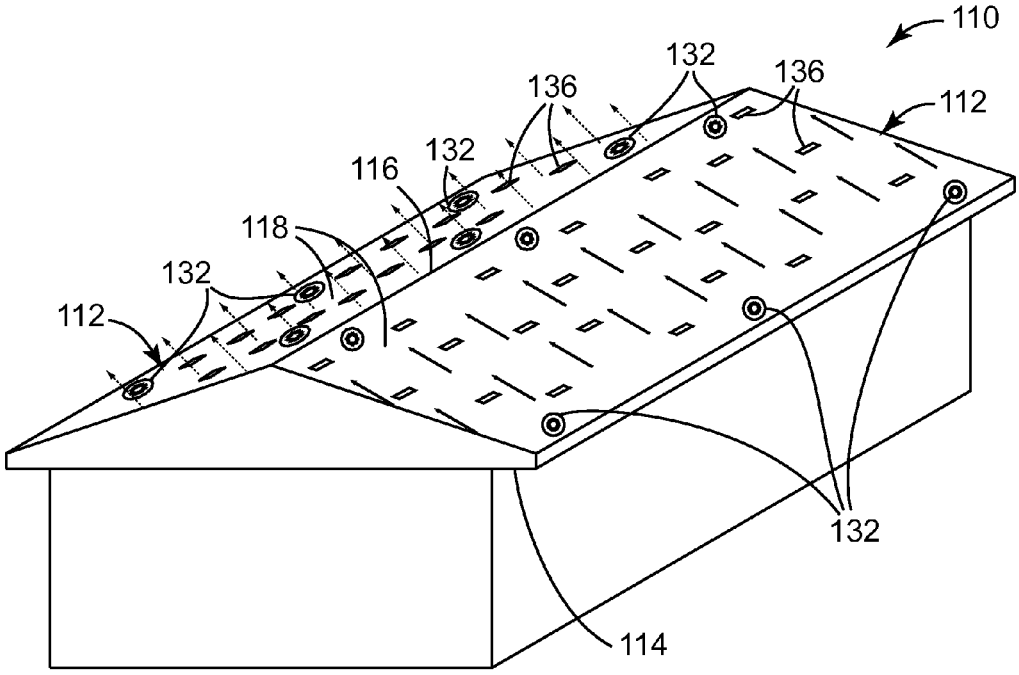
FIG. 5A is a schematic perspective view of a roof system of a further embodiment of this disclosure.
Figure 5B:
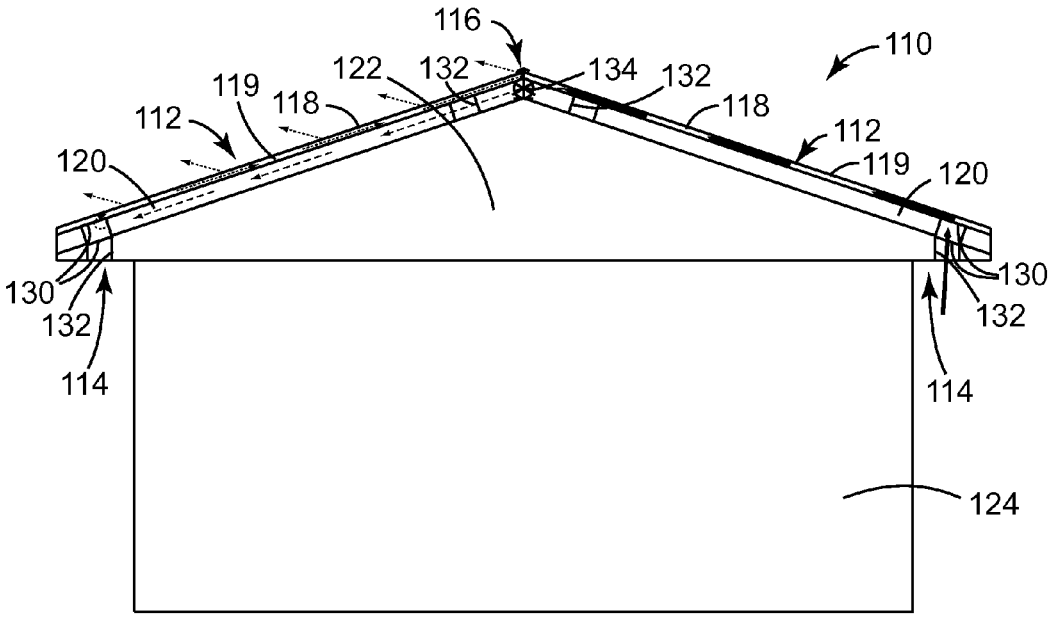
FIG. 5B is schematic side view of the roof system of FIG. 5A.

Referring to FIGS. 5A and 5B, in a third embodiment, to transfer air to a cooler side of a roof using a below-deck solution, blower 132 on right roof portion 112 can be set to push soffit air and blower 132 on left roof portion 112 can be set to pull air. Positions 2 and 4 of air router 134 can be open (see FIG. 10C). The air is then routed from the right roof portion 112 to the left roof portion 112. The air is then pushed through channels 119 provided in or with protective covering 118.

Figure 6A:
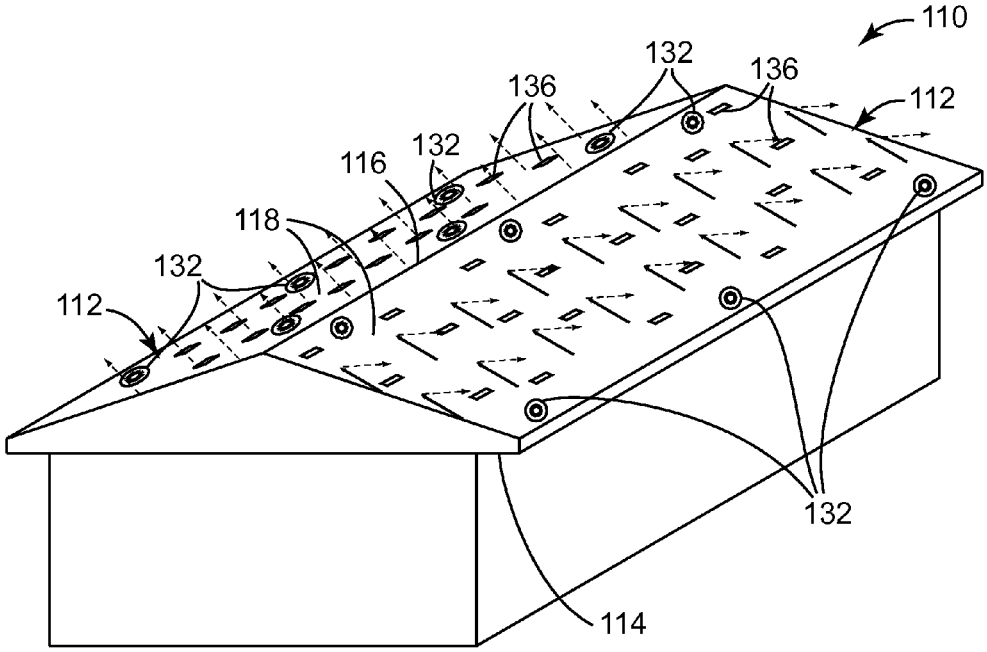
FIG. 6A is a schematic perspective view of a roof system of a further embodiment of this disclosure.
Figure 6B:
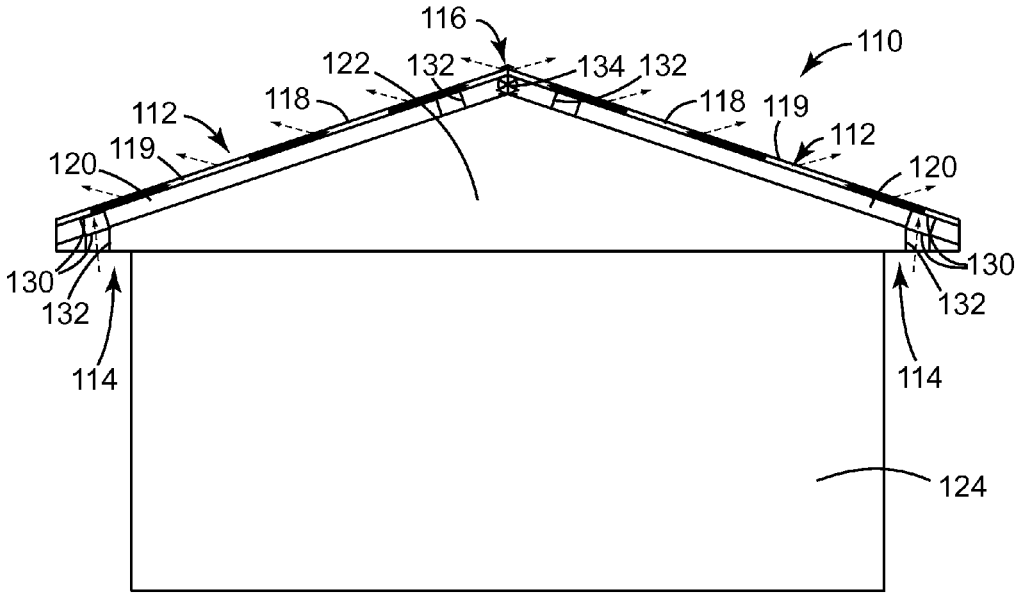
FIG. 6B is schematic side view of the roof system of FIG. 6A.

Referring to FIGS. 6A and 6B, in a fourth embodiment, all positions of air router 134 can be closed (see FIG. 10D) and the right and left blowers 132 can be set to pull outside air using, for example, variable blower speed. This will cause air to be blown onto the roof system 110 through vents (not depicted) included in protective covering 118. This configuration can be useful, for example, when it is desired to blow water, snow, or other debris (such as leaves) off of roof system 110.

Figure 7A:
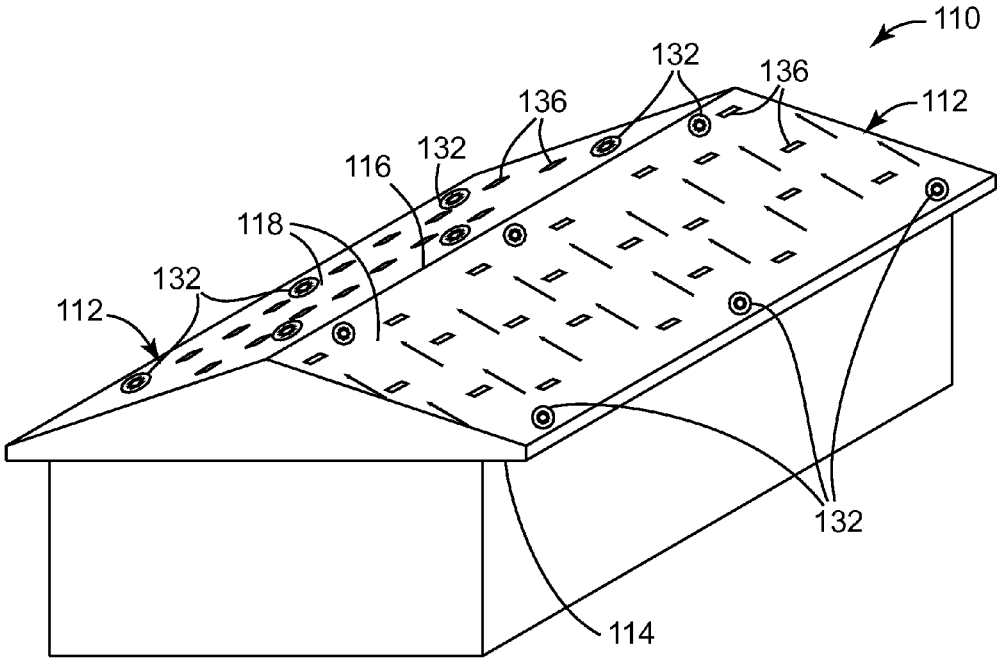
FIG. 7A is a schematic perspective view of a roof system of a further embodiment of this disclosure.
Figure 7B:
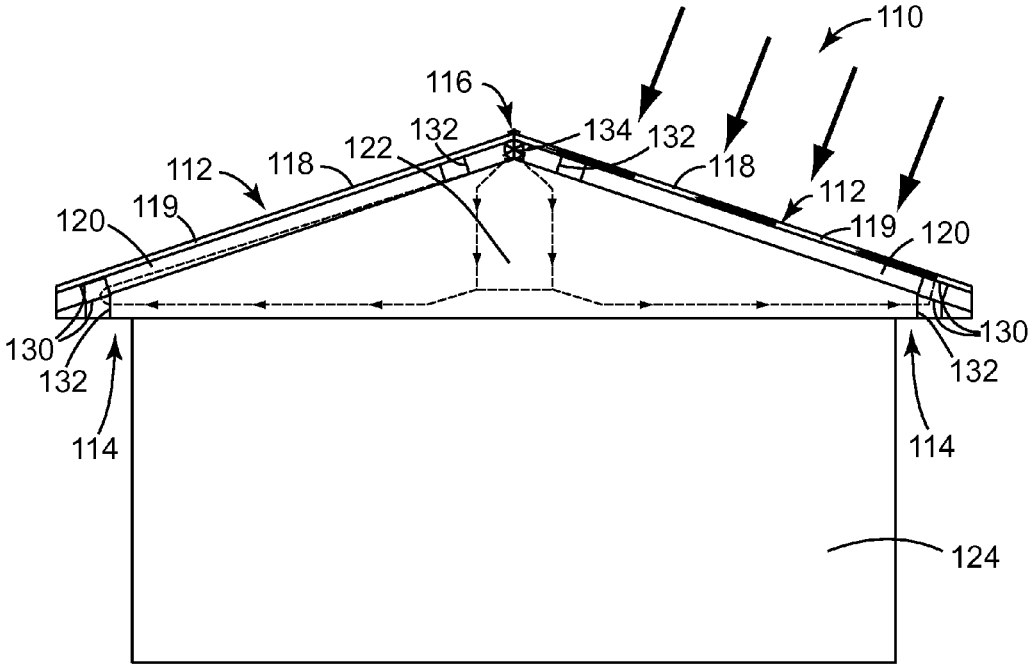
FIG. 7B is schematic side view of the roof system of FIG. 7A.

Referring to FIGS. 7A and 7B, in a fifth embodiment, radiant energy is depicted as impinging upon the right roof portion 112 of roof system 110. In this embodiment, positions 2 and 3 of air router 134 can be open (see FIG. 10E) the soffit ducts (air routers) and blowers/fans are controlled through the software for force air convection direction (pushing or pulling), natural convention in the soffit and attic areas, and balance system ventilation. The left and right blowers 132 can be set to re-circulate warmer air through the channel 119 included in or with the protective covering. The unconditioned space can be used as a buffer to store warm air or cool air depending on the season.

Figure 8A:
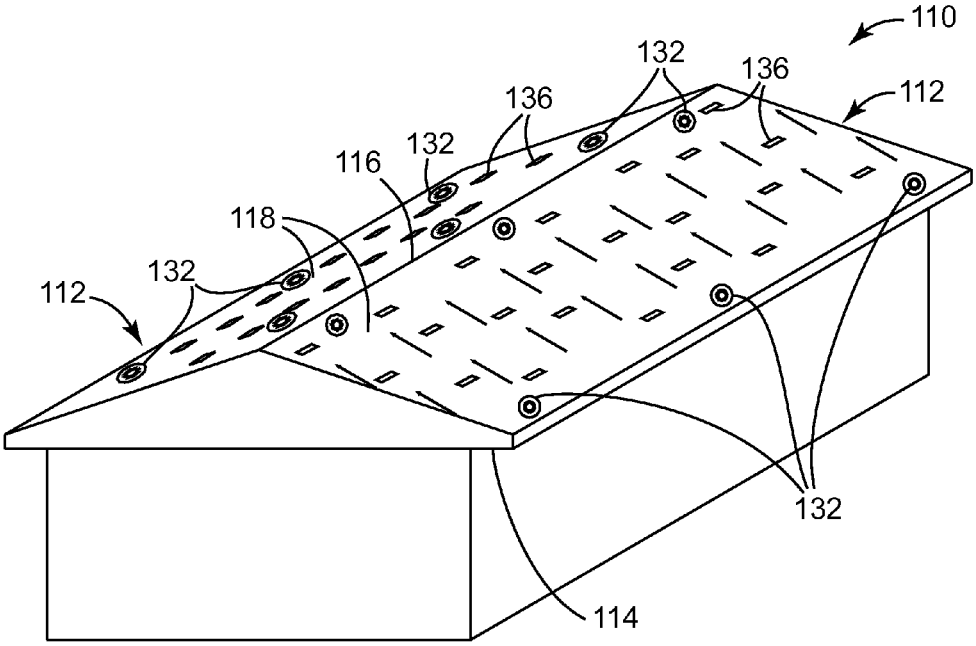
FIG. 8A is a schematic perspective view of a roof system of a further embodiment of this disclosure.
Figure 8B:
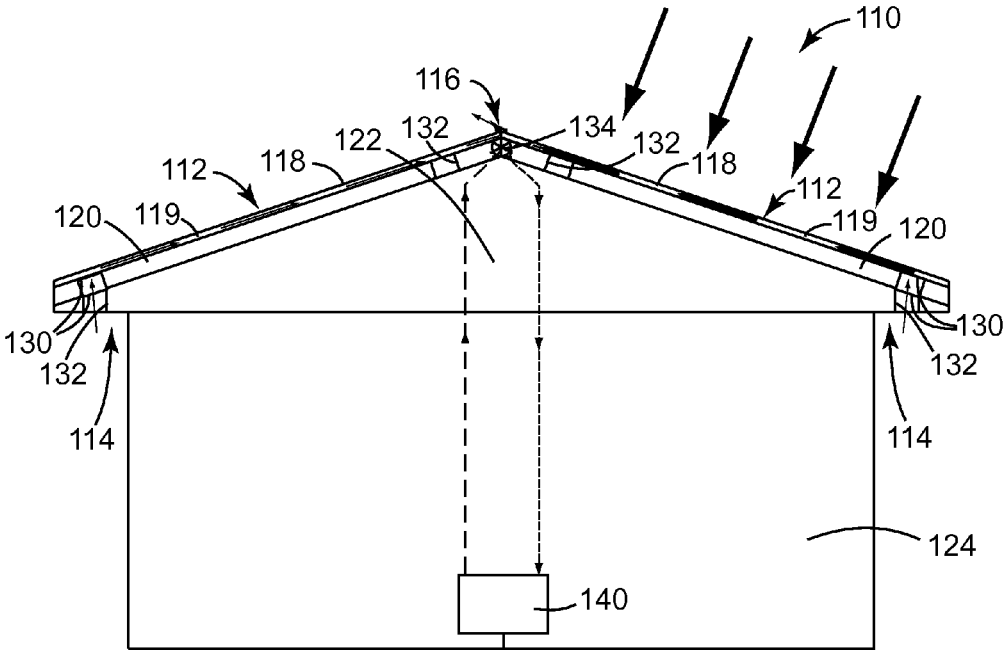
FIG. 8B is a schematic side view of the roof system of FIG. 8A.

Referring to FIGS. 8A and 8B, in a sixth embodiment, in a cold climate case, radiant energy is depicted as impinging upon the right roof portion 112 of roof system 110. In this embodiment, positions 2, 3, 4 and 5 of air router 134 can be open (see FIG. 10F) and the soffit ducts (air routers) and blowers/fans are controlled through the software for force air convection direction (pushing or pulling), natural convention in the soffit and attic areas, and balance system ventilation. The left blower 132 can, optionally, be set to push soffit air and the right blower 132 can be set to push soffit air. New air is routed to flow into a home air make-up unit 140 and old air flows out of unit 140.

Figure 9A:
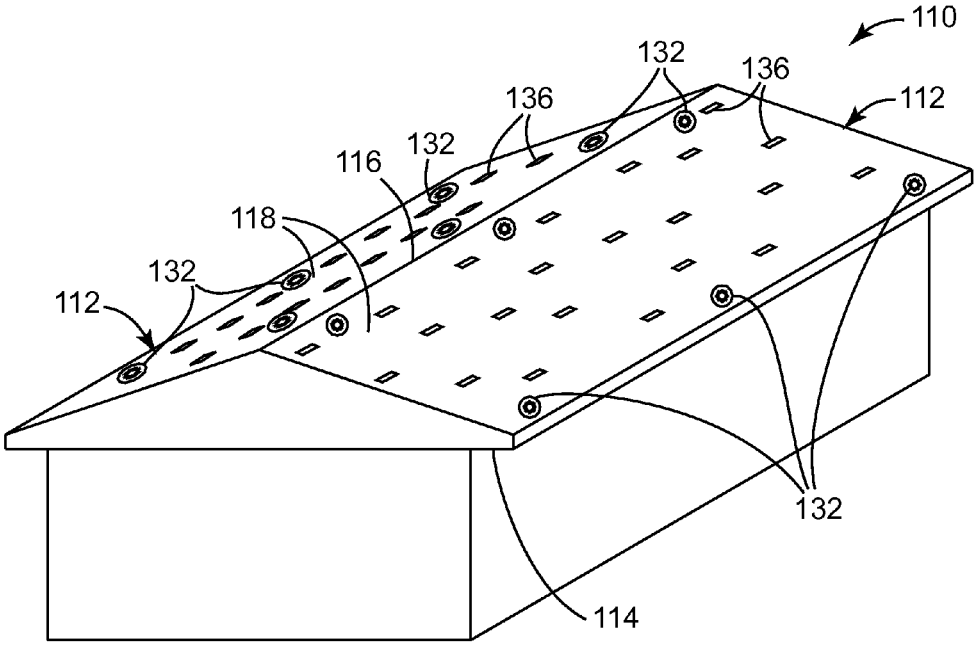
FIG. 9A is a schematic perspective view of a roof system of a further embodiment of this disclosure.
Figure 9B:
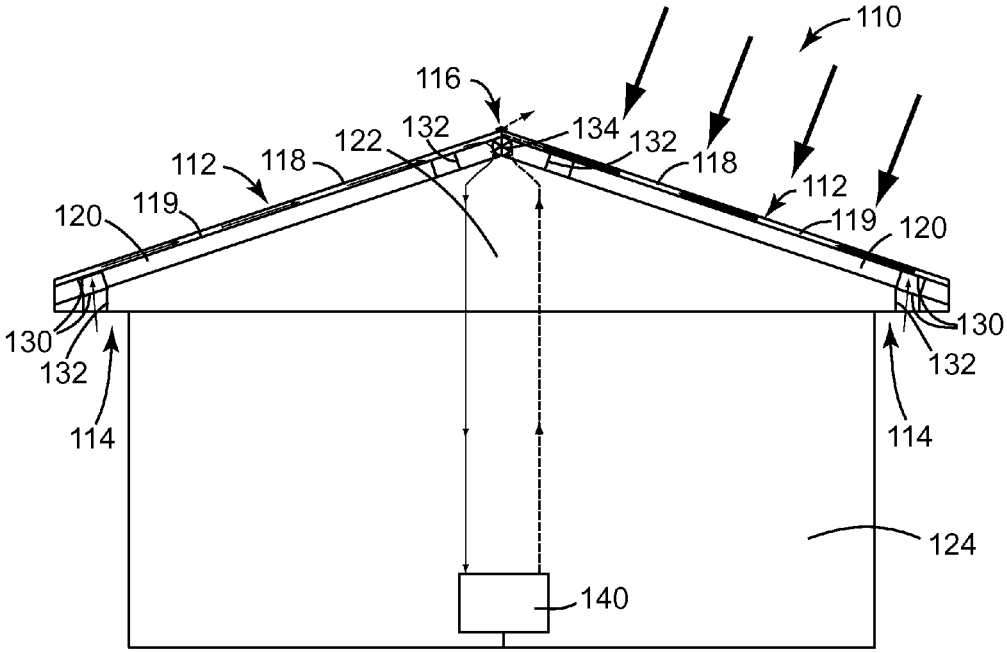
FIG. 9B is a schematic side view of the roof system of FIG. 9A.

Referring to FIGS. 9A and 9B, in a seventh embodiment, in a warm climate case, radiant energy is depicted as impinging upon the right roof portion of roof. In this embodiment, positions 2, 3, 4 and 5 of air router 134 can be open (see FIG. 10F) and the soffit ducts (air routers) and blowers/fans are controlled through the software for force air convection direction (pushing or pulling), natural convention in the soffit and attic areas, and balance system ventilation. The left blower 132 can, optionally, be set to push soffit air and the right blower 132 can be set to push soffit air. New air is routed to flow into unit 140 and old air flows out of unit 140.

Referring to FIGS. 10A-10F, the various air router 134 configurations are depicted schematically for each of the embodiments depicted and described with respect to FIGS. 3-9.

Figure 11A:
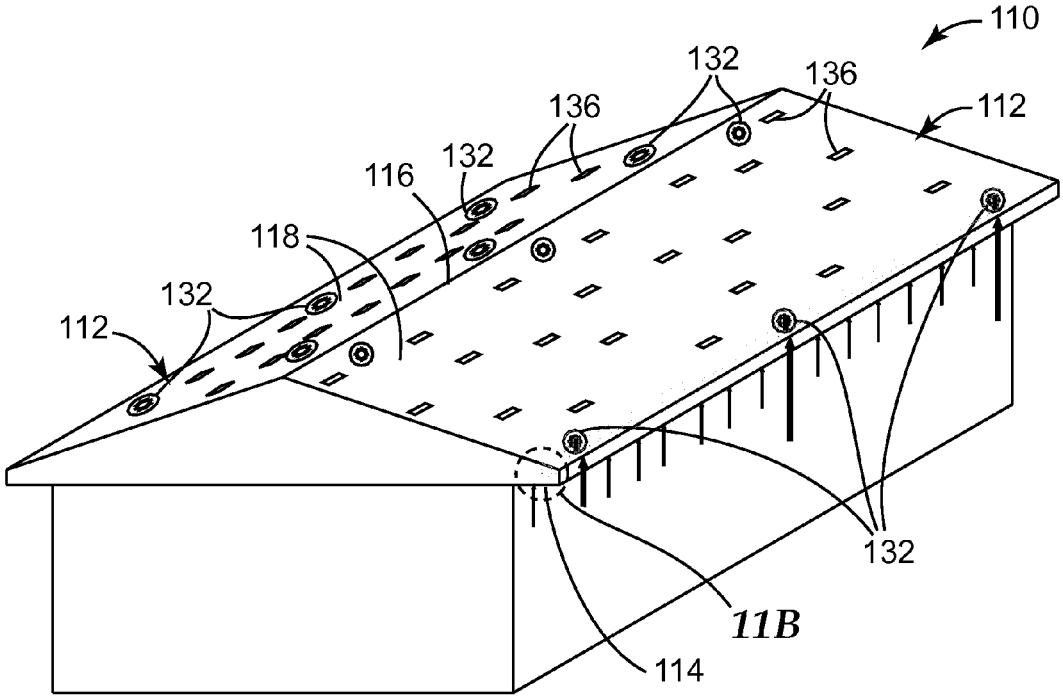
FIG. 11A is a schematic perspective view of a roof system of a further embodiment of this disclosure.
Figure 11B:
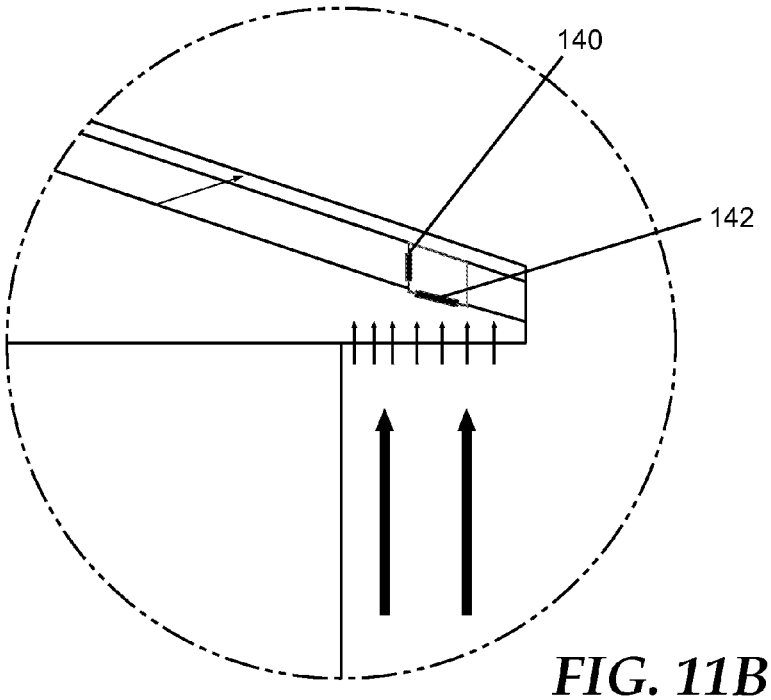
FIG. 11B is a close-up schematic view of a soffit vent (air router) of embodiments of this disclosure.

Referring to FIGS. 11A and 11B, a soffit duct (air router) is depicted. In a first configuration, the soffit duct can be open, by opening a first gate 140, such as an electric-actuated "air gate or linear actuator," to the channel 119 for air flow. It is depicted with open gates for natural convection in the bottom or closed gates for force convection through the respective blowers. In another embodiment, a second gate 142, such as an electric-actuated "side gate," can be open for below deck air flow management.

Figure 12:
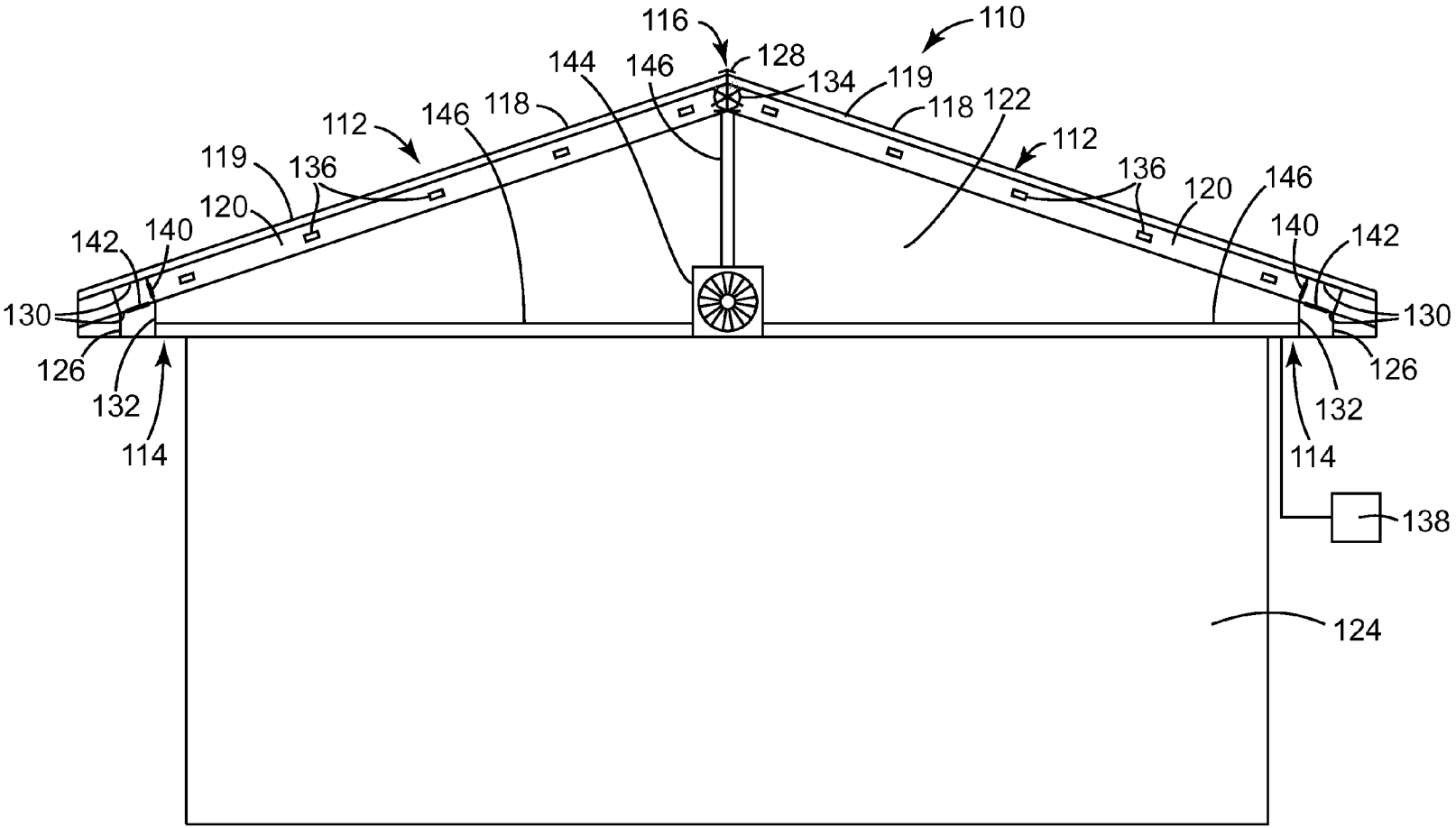
FIG. 12 is a schematic perspective view of a roof system of a further embodiment of this disclosure.

Referring to FIG. 12, in embodiments, a blower 144 can be located or positioned in attic 122 and in fluid (air) communication, such as through ductwork 146, with air routers 134 and air gates 140 and, optionally, second air gates 142 to manage airflow by or within the roof system 10, the environmental thermal loads of the roof system 10, the temperature of conditioned and/or unconditioned spaces in a building, and the ventilation of the conditioned and/or unconditioned spaces in a building, such as, for example, as described above with respect to FIGS. 3-9. To do so, blower 144 can be controlled to selectively push and/or pull air to or from air routers 134 and air gates 140 and, optionally, second air gates 142—depending upon what result is desired.

In embodiments, such as those depicted in FIGS. 3-9 and 11, channels 119, such as those included in above-deck protective covering, that extend up the slope of the deck mate or align with dedicated ports on air router 134, such as the #2 port (right) or #5 port (left) of the air router 134, as depicted in FIGS. 10A-F.

The embodiments of this invention should not be considered limited to the particular examples described herein, but rather should be understood to cover all aspects of the invention as fairly set out in the attached claims. Various modifications, equivalent processes, as well as numerous structures to which the embodiments of this invention can be applicable will be readily apparent to those of skill in the art to which the embodiments of this invention are directed upon review of the instant specification.

What is claimed is:

1. A system for management of a roof having first and second decks covering an unconditioned space in a building and a peak, said system comprising:

a first channel extending from proximate a lower end of the first deck towards the peak and a second channel extending from proximate a lower end of the second deck towards the peak;

a router positioned proximate the peak, said router enabling air flowing to the peak from said first channel to be selectively routed to a plurality of directions, and a selectively openable and closeable vent proximate a lower end of the first deck, such that said vent, when opened, enables air to enter into or exit out of said first channel;

wherein the plurality of directions include out of a peak vent included at the peak and into the atmosphere, and to said second channel.

2. The system of claim 1, wherein said plurality of directions further include one or more directions selected from the group consisting of:

back to said first channel, into the unconditioned space, into an heat recovery unit, into an air make-up unit, and any combinations thereof.

3. The system of claim 2, wherein the system comprises a heat recovery unit, and said heat recovery unit comprises a dryer.

4. A roofing article for use in the system of claim 1, said roofing article comprising a body and a roofing article channel defined therein, such that when said roofing article is arranged on said first deck, said roofing article channel forms at least a portion of said first channel.

5. The system of claim 1, further comprising a covering presented on said first and second decks, said first channel being defined within said covering presented on the first deck and said second channel being defined within said covering presented on the second deck.

6. The system of claim 1, further comprising a covering presented on said first and second decks, said first channel being defined intermediate said first deck and said covering presented on the first deck and said second channel being defined intermediate said second deck and said covering presented on the second deck.

7. The system of claim 1, wherein said first channel and said second channel are positioned above the first deck and second deck, respectively.

8. The system of claim 1, wherein said first channel and said second channel are positioned below the first deck and second deck, respectively.

9. The system of claim 1, further comprising a selectively openable and closeable vent proximate a lower end of the second deck, such that said vent, when opened, enables air to enter into or exit out of said second channel.

10. The system of claim 1, further comprising an air movement component to effect movement of air in at least one of said first and second channels.

11. The system of claim 10, wherein said air movement component is configured to push and pull air.

12. The system of claim 1, further comprising one or more sensors presented with at least one of said first deck or said second deck.

13. The system of claim 12, wherein said one or more sensors comprise a sensor selected from the group consisting of: a temperature sensor, a moisture sensor, a heat flow sensor, an impact sensor, a fire sensor, and a carbon monoxide sensor, or combinations thereof.

14. A method for releasing thermal loads using the system of claim 1, wherein said air flowing to the peak from said first channel is selectively routed out of the peak vent into the atmosphere.

15. A method for collecting thermal loads using the system of claim 1, wherein said air flowing to the peak from said first channel is selectively routed into the unconditioned space.

16. A method for using thermal loads from the first deck to heat the second deck using the system of claim 1, wherein said air flowing to the peak from said first channel is selectively routed to said second channel.

* * * * *